US006893007B2

(12) United States Patent
Asenbauer

(10) Patent No.: US 6,893,007 B2
(45) Date of Patent: May 17, 2005

(54) SAFETY FENCE

(76) Inventor: Christopher J. Asenbauer, 1002 Maple Ave., Beaumont, CA (US) 92223

( * ) Notice: Subject to any disclaimer, the term of this patent is extended or adjusted under 35 U.S.C. 154(b) by 98 days.

(21) Appl. No.: 10/666,810

(22) Filed: Sep. 18, 2003

(65) Prior Publication Data

US 2004/0238807 A1 Dec. 2, 2004

Related U.S. Application Data

(60) Provisional application No. 60/473,871, filed on May 29, 2003.

(51) Int. Cl.[7] ..... E04H 17/02
(52) U.S. Cl. ..... 256/47; 256/19
(58) Field of Search ..... 256/1, 19, 24, 256/25, 32, 26, 47, 49

(56) References Cited

U.S. PATENT DOCUMENTS

| | | | | |
|---|---|---|---|---|
| 351,244 | A | 10/1886 | Baines | |
| 385,531 | A | 7/1888 | Shrader | |
| 766,185 | A | 8/1904 | Harold | |
| 877,076 | A | 1/1908 | Hageman | |
| 2,240,689 | A | 5/1941 | Denton | 256/59 |
| 2,669,434 | A | 2/1954 | White | 256/59 |
| 3,111,303 | A | 11/1963 | Olsen | |
| 3,352,541 | A | 11/1967 | Thom | |
| 3,486,739 | A | 12/1969 | Nelson et al. | 256/65 |
| 4,037,788 | A | 7/1977 | Riley | 239/207 |
| 4,380,327 | A | 4/1983 | Fish | |
| 4,576,364 | A * | 3/1986 | O'Fearna | 256/24 |
| 4,682,762 | A | 7/1987 | Lekavich | |
| 5,102,103 | A | 4/1992 | Putnam | |
| 5,152,508 | A | 10/1992 | Fish | |
| 5,496,016 | A | 3/1996 | Parisien | |
| 5,553,833 | A | 9/1996 | Bohen | |
| 5,664,769 | A | 9/1997 | Sadinsky et al. | |
| D410,289 | S | 5/1999 | Howard et al. | |
| 6,375,164 | B1 * | 4/2002 | Siegler et al. | 256/1 |

OTHER PUBLICATIONS

Brochure Baby Guard Removable Mesh Pool Fences, Tamarae, FL 33309.

* cited by examiner

*Primary Examiner*—John R. Cottingham

(57) ABSTRACT

A safety fencing system is provided which includes a plurality of two-part poles. These poles have a flat edge and a curved edge providing a substantially "D" shape. In the preferred embodiment each flat edge includes a substantially concave portion and a substantially convex portion. These contours nest together when two flat edges are placed adjacent to one another, leaving a curved or round external shape. The nested contours and the flat edges receive a pliable material. These contours assist in "grabbing" the material to prevent it from slippage over time. Fasteners are used to secure the two parts of the poles together, capturing the material there between. Inserts are used in the ground to receive one the bottom end of the poles. Section locks are used to secure one section of fence to an adjacent section of fence. A gate is provided with two gate frame members. A first gate frame member supports the gate door and the second gate frame member supports the gate stop. The pole members of the gate frame members are adjustable in height so as to allow the gate frame members to support the gate in a level orientation. This is critical to a functional locking gate over time.

26 Claims, 9 Drawing Sheets

SAFETY FENCE

This application claims the benefit of Provisional Application No. 60/473,871, filed May 29, 2003.

FIELD OF THE INVENTION

The present invention generally relates to fences and other physical boundary devices. More specifically, the present invention relates to safety fences for swimming pools and other potentially dangerous environments.

BACKGROUND OF THE INVENTION

Restricted access to specific areas of environments in general have become a part of our daily lives. Some times the purpose of the restriction is to protect the integrity or environment of the area, and some times it is to protect the individual from potential hazards within the protected area. In either case, a common form of restriction is a gated fence. This provides access only in the area of the gate, and therefore can be monitored much easier. In the absence of the ability to monitor the gate, the gate can be locked to prevent any access to the area.

Swimming pools are one such hazard area. According to a fact sheet published by the Pasadena California Fire Department regarding swimming pool safety, a swimming pool is 14 times more likely than a motor vehicle to be involved in the death of a child age 4 and under. Each year an estimated 5,000 children ages 14 and under are hospitalized due to near-drownings. Approximately 50% of preschooler drownings occur in residential swimming pools. For many years self-locking gates and fenced yards have been required on homes with swimming pools. This helps with the neighbor's children wandering into the backyard pool area, but what about children who live at the home or are guests that knowingly enter the home or yard. The reported drownings reflect this still present danger. As a second line of defense, a pool fence is used that includes an attractive "see through" fence. This fence is installed directly into the ground or preferably the cement or brick foundation or fascia that surrounds the pool. The gate can be locked when adults are not around the pool to watch children. This eliminates the potential for children to wonder into the pool area from the house.

SUMMARY OF THE INVENTION

In one aspect, the invention features a safety fence including a plurality of substantially longitudinal poles. Each pole includes a first part and a second part. The poles may also include a convex portion on a surface of the first part and a substantially concave portion on a surface of the second part. Both may be present on each part of one on each. A pliable fencing material is received between the poles. A plurality of inserts is used and is adapted to receive one end of each of the poles. A plurality of fasteners, preferably machine screws, are used that are adapted to secure the first part to the second part while capturing the fencing material there between, whereby said material is captured between the substantially concave portion and the substantially convex portion of the poles clamping them in place.

The poles, which include a first part and a second part preferably includes a flat edge and a curved edge, thus providing each part as a substantially "D" shape. The substantially convex portion and the substantially concave portions as previously noted are provided on the flat edge of each part. The curved edge optimally includes a relief track, which is provided near the midpoint of the curved edge. In the preferred embodiment the pliable fencing material is comprised of a mesh material with a reinforced material border on an upper edge and a lower edge.

The inserts include a closed end and a flange on an opposite end with a substantially cylindrical portion there between. This substantially cylindrical portion may include a ridge provided on an exterior thereof. This ridge can take a variety of forms but preferably includes a tapered ring provided around the perimeter of the cylindrical portion. A mounting hole can also be provided, located substantially orthogonal to a long axis of the insert. The device may also include a plurality of cup shaped caps, each with an open end adapted to receive a second end of one of the longitudinal poles, opposite to the insert.

Grip mounts may also be used. Each grip mount includes a first half and a second half that are adapted to receive an outside edge of each of the first part of the pole and the second part of the pole respectively. The first half may include a fastener hole and the second half may include a threaded portion. A fastener is provided through the fastener hole and received by the threaded portion securing the first half to the second half about said pole. The grip mounts may also include a plurality of cleats provided adjacent to the fastener hole. The cleats contact the pliable fencing material, further securing it to the pole.

The device may also include a section lock. The section lock includes a ring end secured to a first mounting bolt on a first pole and a loop end adapted to be received by a second mounting bolt on a second pole. The loop end may include more than one loop. The loop(s) are preferably adapted to receive a lock through the loop that is received by the second mounting bolt, thus locking the section lock between the first pole and the second pole. Also, the section lock may include a pair of slide arms, which are movably mounted to the section lock and adjacent to the loop. A bias can be used to maintain a free end of the slide arms toward the loop end. The slide arms may also include end holes adapted to receive a lock, enabling the slide arms to be locked and therefore restricted in movement toward said ring end.

Another aspect of the preferred embodiment is a gate section, which includes a gate door that is pivotally mounted to a first gate frame member. A second gate frame member is provided adjacent to the gate door, opposite to the first gate frame member and includes a gate stop that mates with a gate ear on the gate door. The gate stop and the gate ear may include at least one hole adapted to receive a lock thus enabling the gate door to be locked in a closed position.

The first gate frame member and the second gate frame members are preferably comprised of a first part and a second part, whereby the pliable material can be received between them and fastened together securing the material there between. The first gate frame member and the second gate frame member may include an insert adapted to receive at least one fastener in a flange, the flange located on a distal end of the insert. A mounting collar is also provided that is variably mounted near a distal end of a pole of the gate frame member. The mounting collar includes a flange that is adapted to receive the fastener, such as with a threaded insert. This fastener secures the mounting collar to the insert enabling variable placement of a distal end of the pole relative to the flange of the insert. This provides vertical adjustment of the gate frame members to ensure a proper functioning and locking gate.

In another aspect, the invention includes a method of providing restricted access to a controlled area such as a swimming pool. This method includes providing a series of elements as previously noted and the steps of drilling a plurality of holes around the controlled area, assembling the longitudinal poles in the inserts and placing the inserts with the poles into the holes. Then the pliable fencing material is placed around the controlled area and between the first part and the second part of each of the poles. The poles are then fastened together by mounting the first part and the second parts of the poles together using the fasteners, thereby capturing said pliable material there between and creating a controlled barrier.

BRIEF DESCRIPTION OF THE DRAWINGS

The foregoing and other objects of this invention, the various features thereof, as well as the invention itself, may be more fully understood from the following description, when read together with the accompanying drawings, described.

For the most part, and as will be apparent when referring to the figures, when an item is used unchanged in more than one figure, it is identified by the same alphanumeric reference indicator in all figures.

DETAILED DESCRIPTION OF THE PREFERRED EMBODIMENT

Figure 1:
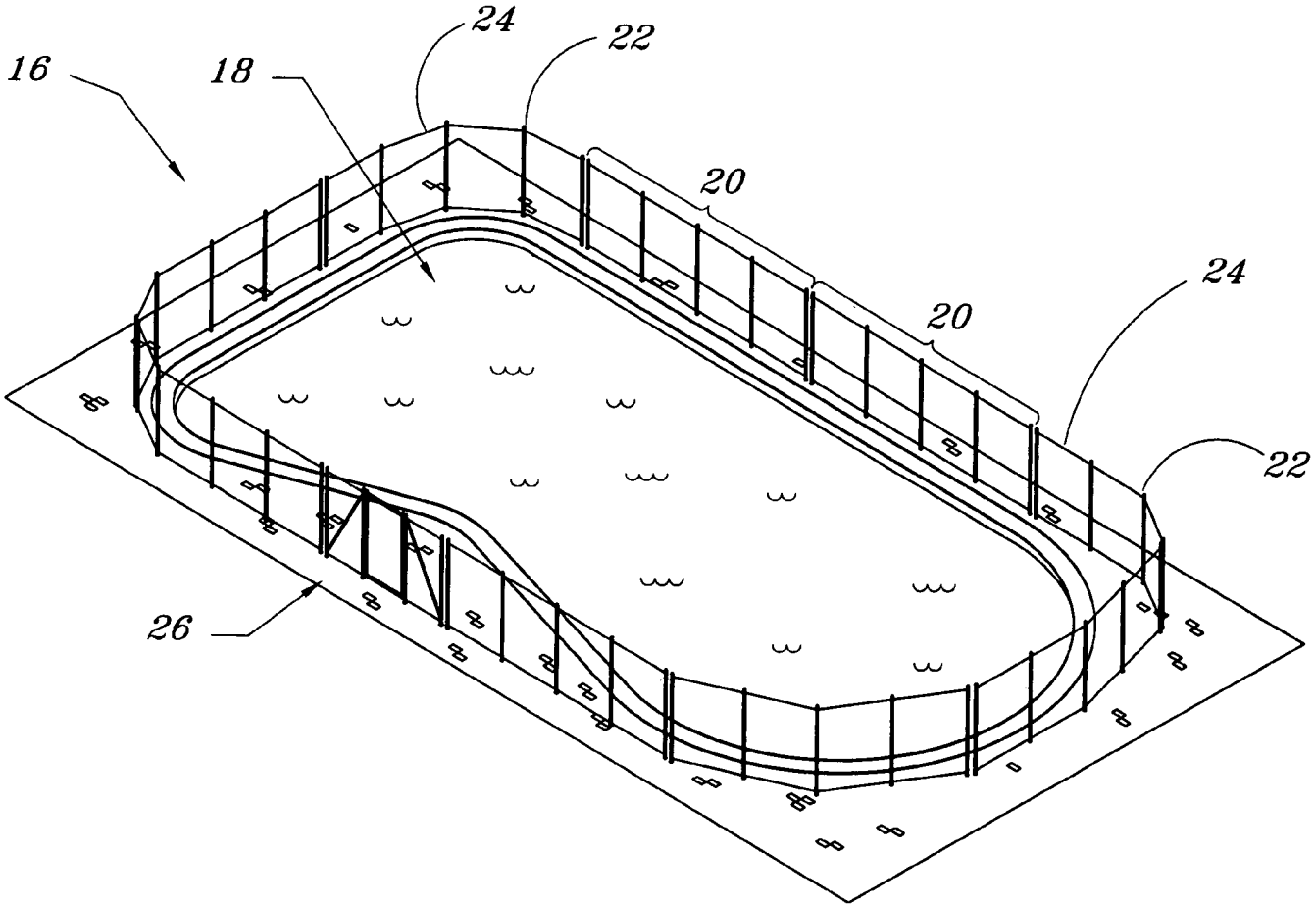
FIG. 1 is an isometric view of a safety fence placed around a swimming pool, the fence produced in accordance with the present invention.

The present invention is safety fencing system and method that accomplishes the ease of instillation, secure mounting of the fence material to the poles and adjustable height gate frame members to enable a consistently locking gate. Referring to the drawings, FIG. 1 shows a fence system 16 around a swimming pool 18. The fence system 16 includes a series or fence sections 20, which are adjacently positioned to another section 20. The use of fence sections 20 rather than one continuous fence is advantageous to the instillation of the system 16, but is not critical to the novelty of the invention. In this disclosure, each fence section 20 includes five individual poles 22, one on each end and three substantially equally spaced there between. Between the end poles 22 is a fence material 24 that is supported by all the poles 22. The details of the attachment are discussed in more detail throughout this disclosure.

A gate section 26 is provided to allow access to the pool area 18. The value of the gate 26 is that this restricts access of any user to the pool area through this one "lockable" section. More than one gate section 26 can be provided if so desired. In this example only one is used but it is understood that multiple gates could be provided without altering the novelty of the invention as disclosed.

Figure 2:
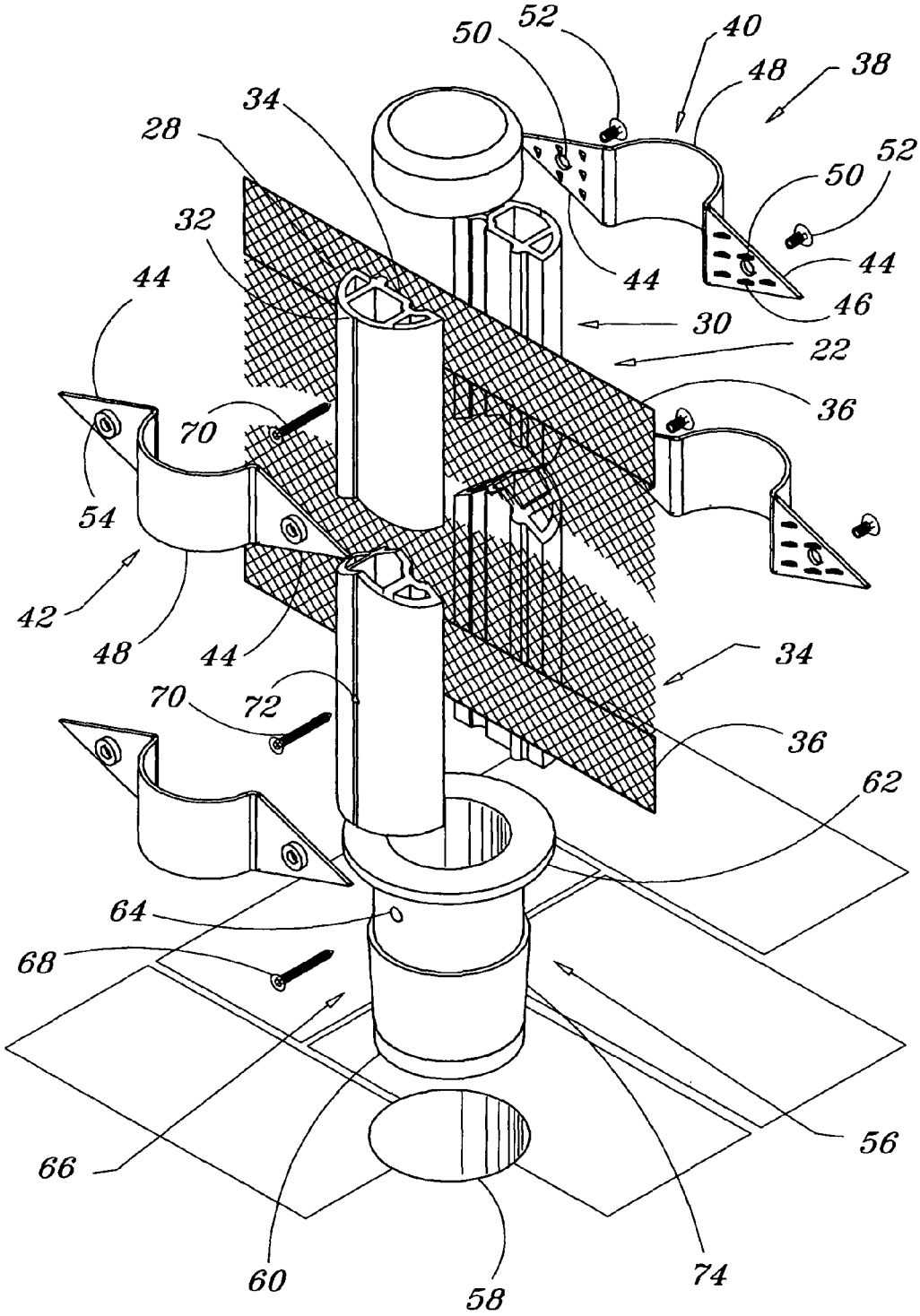
FIG. 2 is an exploded view of a typical pole of the safety fence, the pole and mesh fence are shown with the middle sections removed to better illustrate the top and bottom portions of the pole including its mounting features, the device is produced in the accordance with the present invention.

In FIG. 2 an exploded view of a pole assembly is shown. The middle sections of the pole and fencing material have been removed to better show the detail of the invention. The pole 22 is comprised of a first part 28 and a second part 30. These parts (28 & 30) mate together to make one pole 22. The pole can be of a variety of forms, but it has been determined by the inventor that each part (28 & 30) of the preferred embodiment include a substantially "D" shape with a curved edge 32 and a flat edge 34. Variations in this shape will be disclosed later in this application.

Between the first part 28 and the second part 30 of the pole 22 is a pliable mesh material 34. This material preferably includes a reinforced material border 36 on the top and the bottom edges. This material border 36 supplies tensile strength to the fence material 34. This allows the fence material 34 to be stretched tight without structural failure in the fence material. Holding the fencing material in place is critical to the function of the device. The primary application of this fencing system is to prevent children from entering a dangerous area, especially near a swimming pool. Children are natural "climbers". So grabbing and pulling on the fence is to be expected. If any play in the fence by sagging or especially if any accessible areas are revealed near the bottom of the fence, this is an open invitation for a child to pass through this now ineffective boundary. Not only does this place the child at risk, but in the event of an accident, this potentially unnoticeable entry that was small enough for a small child to pass through would not permit an adult to squeeze through. This would retard any rescue attempts of an endangered child.

To further aid in securing the material 34 to the pole 22, a set of grip mounts 38 are provided. These are an additional security feature. The grip mounts 38 are comprised of a first half 40 which mates to a second half 42. The inside surface of the ears 44 include cleats 46. These cleats 46 are preferably set on an angle relative to the surface of the ear 44 and are angled toward the center section 48. The first half includes a fastener hole 50 (in this case two) with fasteners 52 that are received thereby. The fasteners 52 screw into the respective threaded portions 54 to secure the grip mounts 38 to the assembled pole 22 with the cleats digging into the material portion 36 of the fence material 34. A similar version can be used for the bottom portion of the fence as the top.

The pole 22 is received by an insert 56, which is then inserted into a hole 58 cut into the floor, ground, brick fascia or other surface surrounding the pool or other critical area. The insert 56 has a "cup like" design in that there is a closed end 60 on the bottom to support the distal end of the pole 22 when inserted. A flange 62 is provided on the opposite or open end. The flange limits the distance the insert 56 and therefore the pole 22 will be placed into the ground. This consistence is important not only to the aesthetic beauty of the fence system, but also to prevent the poles 22 from being unstable by being placed to shallow in the ground or having a pole 22 that is to short because it is to far in the ground.

A mounting hole 64 is provided on the substantially cylindrical portion 66 of the insert 56, which is located between the flange 62 and the closed end 60. The mounting hole 64 is positioned substantially orthogonal to a long axis of the insert 56. This hole receives a fastener 68 and is screwed into the pole 22 inserted in the insert 56. This secures the pole 22 to the insert in an area below the flange. Therefore when the insert is placed in the hole 58 up to the flange 62, the fastener 68 is under ground.

A relief track is provided in the outside or curved edge 32 of the first part 28 of the pole 22. This provides a marker to assist the installer with positioning additional fasteners 70 which are used to secure the first part 28 to the second part 30. The inventor has found it beneficial to place a pilot hole 72 in the pole 22 prior to inserting the fastener 70. This is not always necessary depending upon the material of the pole 22 and the type of fastener 70. The preferable fastener is a self-tapping metal machine screw and the preferred pole 22 material is aluminum.

Another unique feature to the insert is provided on the cylindrical portion 66. This is the ridge 74. The ridge 74 is a raised portion along one section or as in this case around the perimeter of the cylindrical portion 66 of the insert 56. Here this ridge 74 is in the form of a tapered ring. The function of the ridge 74 is similar to a barb on an arrow. The insert 56 is placed in the hole 58 and is locked into place, capturing the pole 22 with it. Since the fastener 68 is below the surface of the ground, the pole 22 is now permanently mounted to the ground.

Figure 3:
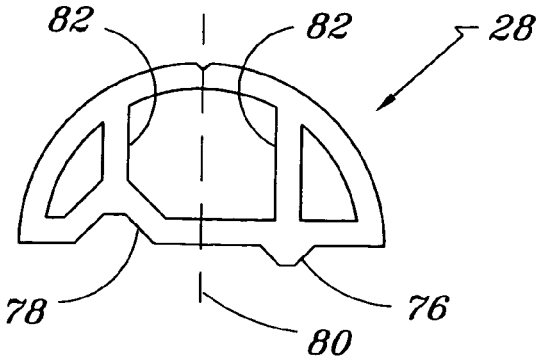
FIG. 3 is an end view of a one half of a vertical pole of the safety fence, the pole shown as preferred embodiment of the present invention.
Figure 4:
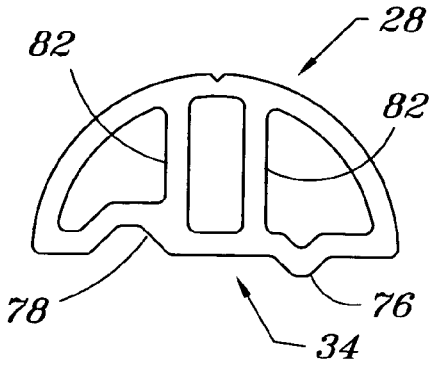
FIG. 4 is an end view of a one half of a vertical pole of the safety fence, the pole shown as an alternative to the preferred embodiment of the present invention.
Figure 5:
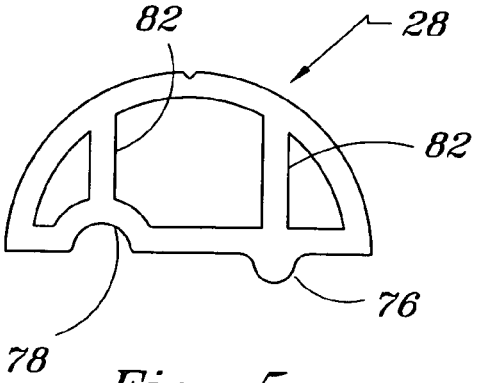
FIG. 5 is an end view of a one half of a vertical pole of the safety fence, the pole shown as an alternative to the preferred embodiment of the present invention.

Alternate forms of a first part 28 of a pole 22 are shown in FIG. 3–FIG. 5. Optimally, the first part 28 is the same as the second part only reversed. This allows for the same part to be used only reversed, thereby facing the other way. This reduces tooling costs. It has been disclosed that it is of paramount importance to maintain a rigid support of the fence material 34 by the poles 22. The inventor has devised another method of adding to this frictional resistance between the parts (28 & 30) of the pole 22 and the fencing material 34. That is the user of a convex portion 76 that when the part is turned over nests into a concave portion 78 equidistant from the midline 80 of the part 28. These portions (76 & 78) can take a variety of shapes from angular, as in FIGS. 3 & 4 or rounded as in FIG. 5. Additional ribs 82 may be used to add additional structural support. These portions (76 & 78) are located in the flat edge 34 of the portions in that these sides mate together leaving a cylindrical outside appearance.

Figure 6:
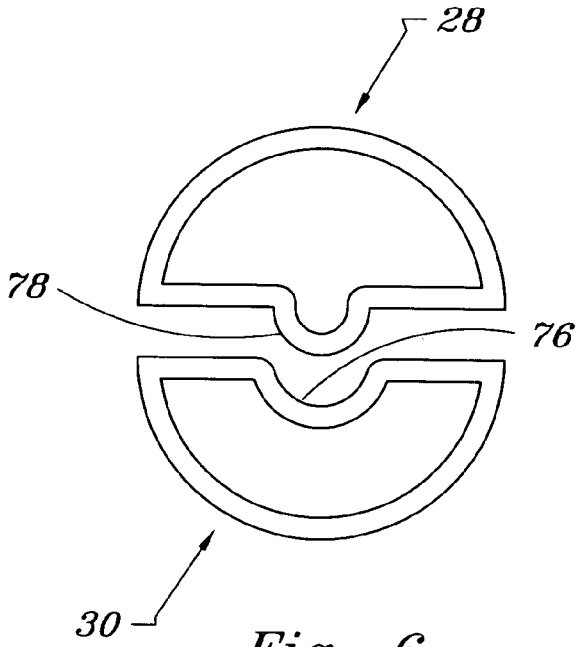
FIG. 6 is an end view of a variation to the preferred embodiment of a pole combination in that one part includes a concave portion and one part includes a convex portion, the parts produced as an alternative to the preferred embodiment to the present invention.
Figure 7:
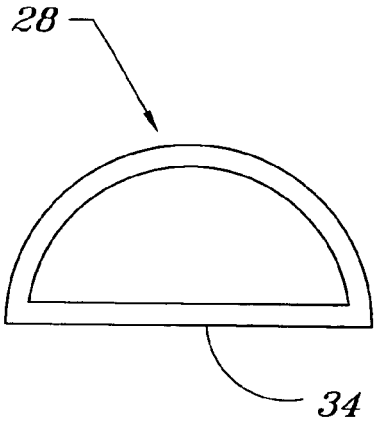
FIG. 7 is an end view of another variation to a pole section in which the flat portion does not include any convex or concave portions, the pole section produced as an alternative to the preferred embodiment to the present invention.

Providing both the convex 76 and concave 76 portions in each part (28 & 30) is not necessary, simply preferred. The alternate is shown in FIG. 6 in which one part includes the convex portion 76 and the other part includes the concave portion 78. As an alternative, if under some circumstances the convex and concave portions are not advantageous, a flat "D" shaped version is shown in FIG. 7. In some cases with certain fence materials, this shape may be preferred. It has been determined by the inventor that the convex and concave portions in each part of the pole 22 is preferred.

Figure 9:
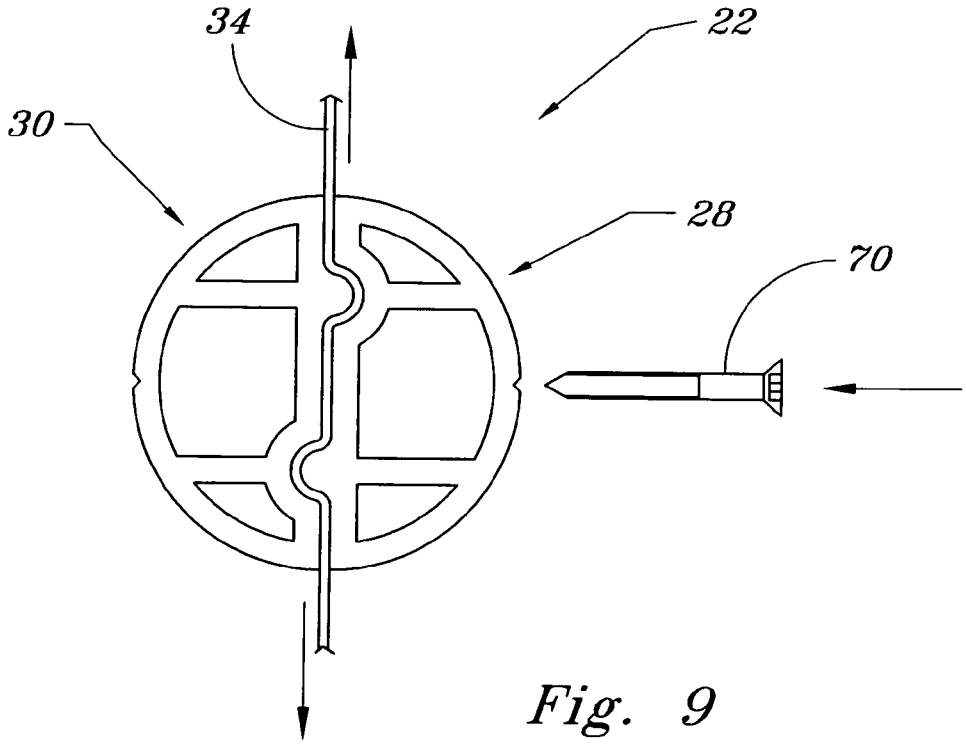
FIG. 9 is and end view of that as in FIG. 6 with the pole portions nested together, capturing the fence material and prior to fastening with the screw.
Figure 10:
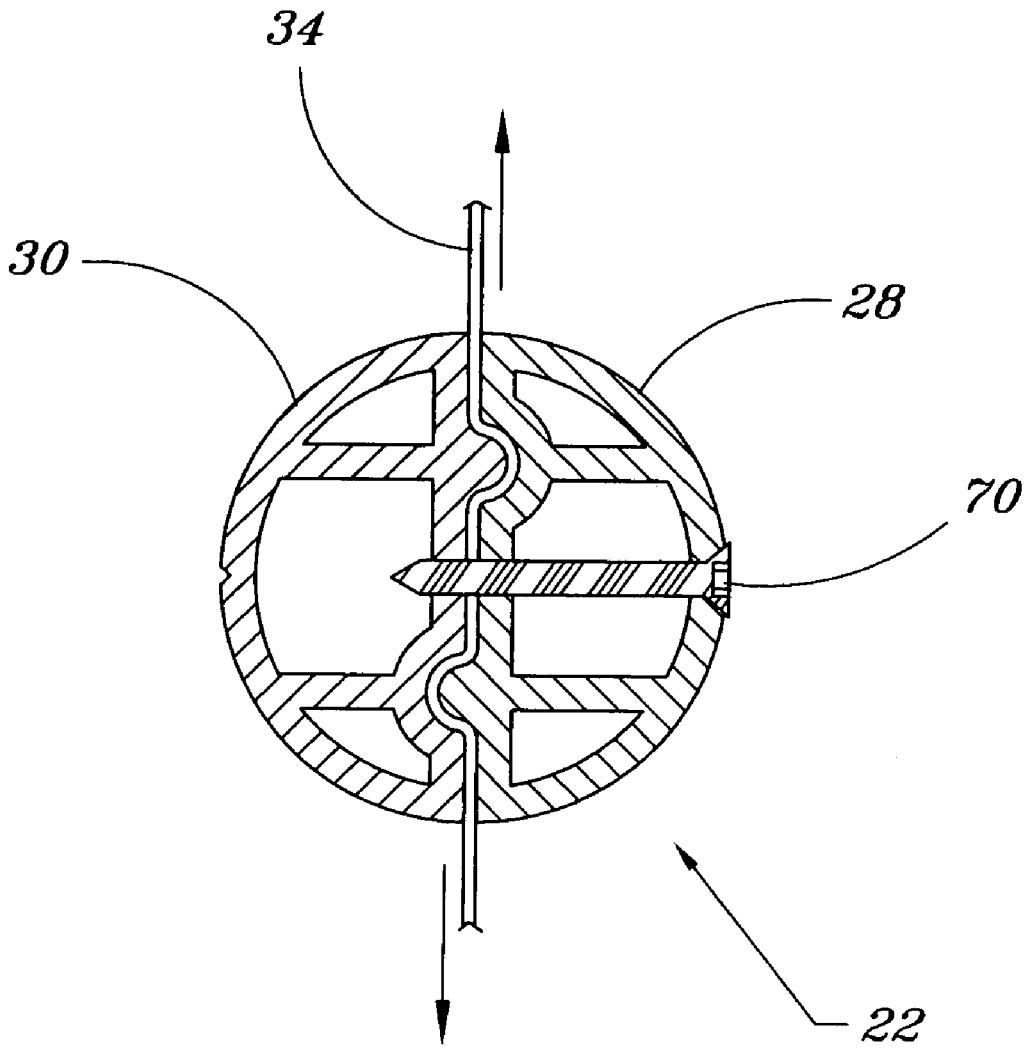
FIG. 10 is a sectioned view of the fully assembled fence pole as illustrated in FIG. 6.

In any form of the invention that uses a convex and concave combination, an additional advantage exists beyond the added surface area to provide a frictional load against the material 34 slipping and sliding across the pole 22, and deforming the shape of the material 34 to necessitate conforming to the shape of these parts (76 & 78), both increasing the resistance against sliding. That advantage is by deforming the material when it is clamped into the shape provided by the poles 22, the material is tightened because some material is "pulled into" the pole 22 due to the deformed shape. It has previously been discussed how important it is to provide and maintain a tight fence. This feature provides an additional tensioning mechanism during the instillation process. This is illustrated in FIGS. 8–10.

Figure 8:
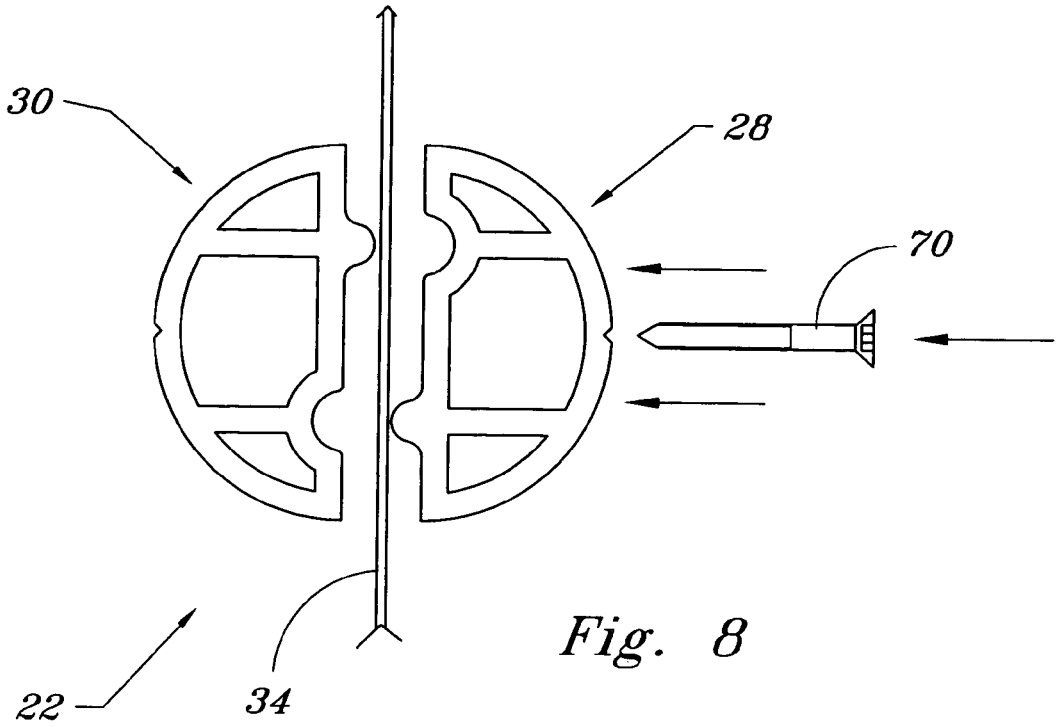
FIG. 8 is and end view of two pole portions as they would typically be assembled with the fence material there between and fastened by a screw, the assembly shown as a preferred embodiment of the present invention.

In FIG. 8 the first part 28 and the second part 30 of a pole 22 are shown how they fit together when one is inverted relative to the other. The fence material 34 is positioned there between a fastener 70 positioned to secure the parts (28 & 30) together. In FIG. 9 the first part 28 and the second part 30 are pressed together with the fence material 34 conforming to the shape of the parts (28 & 30). This illustrates how the fence material 34 is "drawn into" the pole 22 when assembled. In FIG. 10 a sectioned view of the assembly is shown as secured with the fastener 70.

Figure 11:
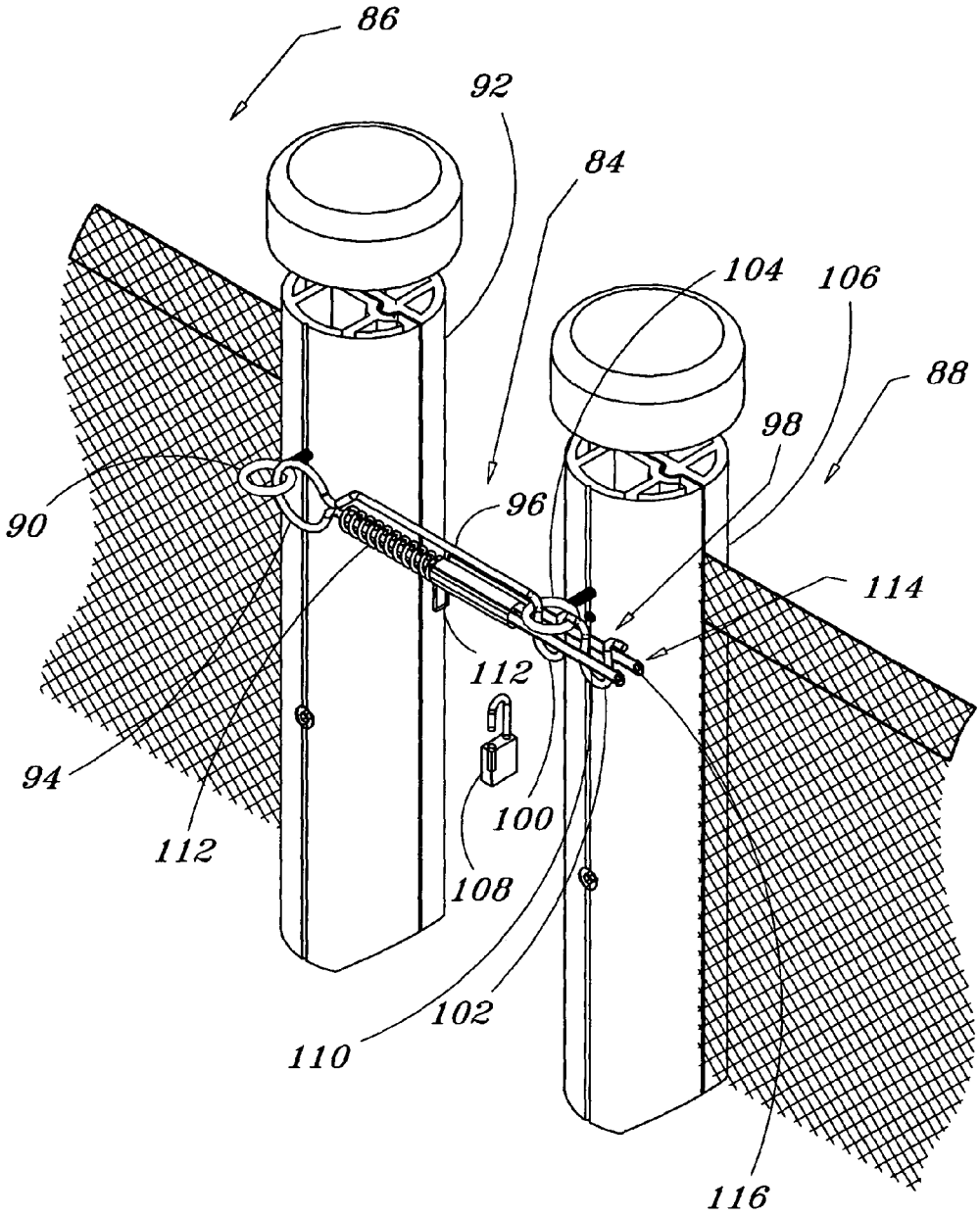
FIG. 11 is an isometric view of the top portions of two adjacent fence sections showing the spring clip and optional lock to secure the sections to each other.

FIG. 11 shows a section lock 84 that secures one fence section 86 to an adjacent fence section 88. A first mounting bolt 90 is secured into the first end pole 92. This mounting bolt 90 can take a variety of forms but optimally an "eye-bolt" is used where the free end of the threaded shaft is a closed ring or a partially complete arc such as a "C" shape. The section lock 84 can include a sliding lock feature as shown here or as a basic clip style as in FIG. 12. The general elements as shown in FIG. 11 are applicable to the simplified form in FIG. 12. FIG. 11 details a closed or substantially closed curve or ring 94 at one end and mounted to the first mounting bolt 90. In this form, the device includes a pair of longitudinal shafts. A raised shaft 96 is provided for structural support for the loop end 98 of the section lock 84. The loop end 98 includes a bent loop 100, and in this case, a second loop 102 is also provided. One of the loops (100 & 102) is received by a second mounting bolt 104, which is mounted to the second end pole 106. The bottom portion of the loop passing through the "eye" of the bolt 104 and extends beneath the bottom of the "eye". This lower exposed portion of the loop 100 allows a lock 108 to be received therein, thus locking the section lock 84 to the second mounting bolt 104. The purpose of a second loop (or third, or any number) is to provide multiple distances in which the section lock 84 could be used. Sometimes adjustments in spacing need to be made to fit a fence section within a given area, or tolerances in the installation process can make this gap between adjacent fence sections vary slightly. Multiple loops 100 enable a single part 84 to be used with this variable spacing. Another locking feature is included with the use of slide arms 110, which are movably mounted on a second shaft (not shown), which runs parallel to the raised shaft 96. This second shaft also holds the bias 112, here in the form of a compression spring. Pressing the lip 114 toward the ring end 94, thus compressing the spring 112, actuates the slide arms 108. One or more of the loops 102 are revealed as the free end 114 moves toward the ring end 94. If the free end 114 is desired not to be moved, the lock 108 can be inserted through end holes 114 near the free end 114 of the side arms 110. The lock 108 then prevents the arms 110 from being retracted and releasing the section lock 84 from the second mounting bolt 104.

Figure 12:
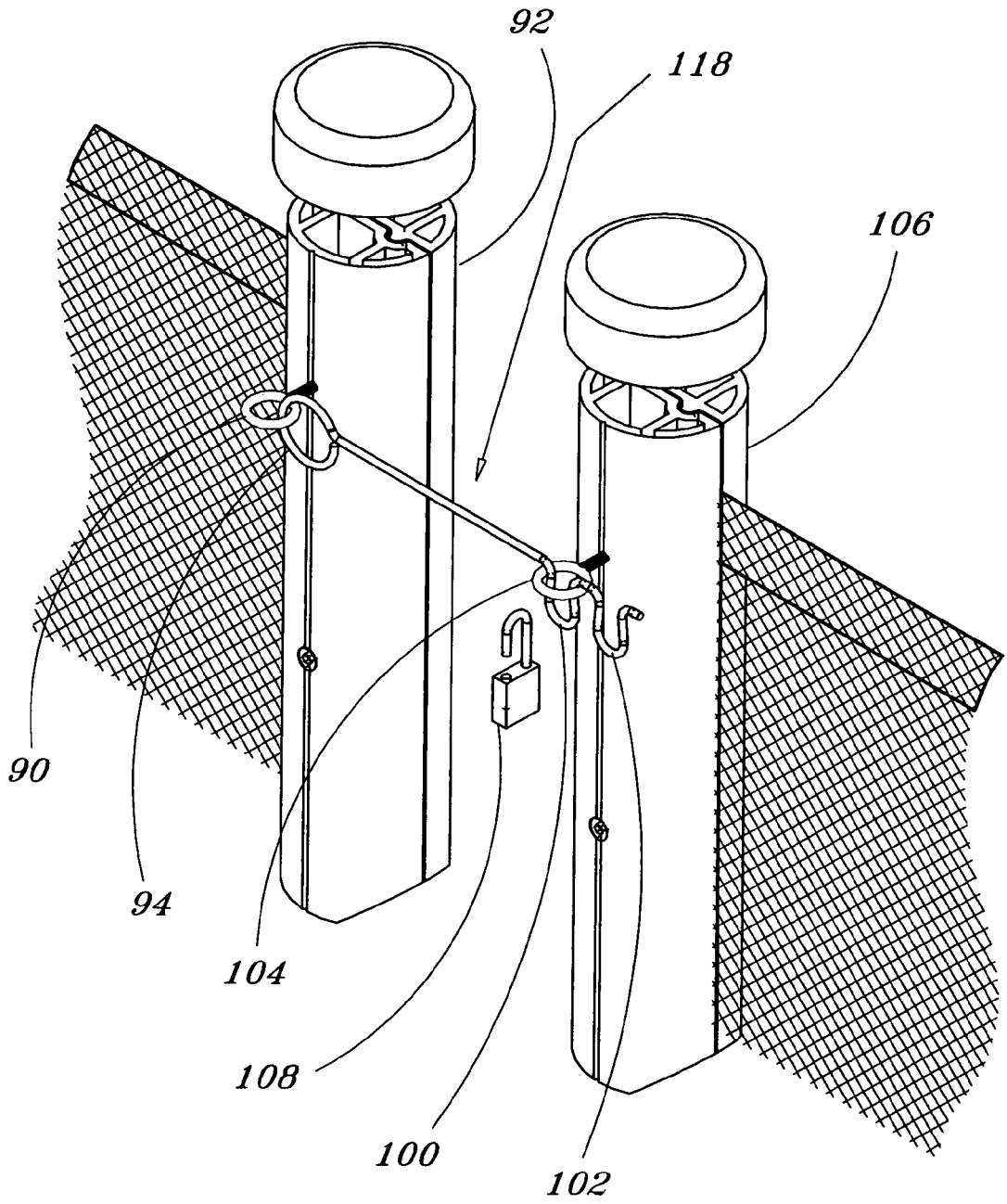
FIG. 12 is an isometric view of the top portions of two adjacent fence sections showing an alternative spring clip and optional lock to secure the sections to each other.

The alternative form of the section lock 118 is shown in FIG. 12. Here the slide arms are not used. The first mounting bolt 90 receives the ring end 94 and the second mounting bolt 104 receives the first loop 100. The lock 106 is provided to the received by the loop 100 and thereby prevent it from passing through the eye of the second mounting bolt 104.

Figure 13:
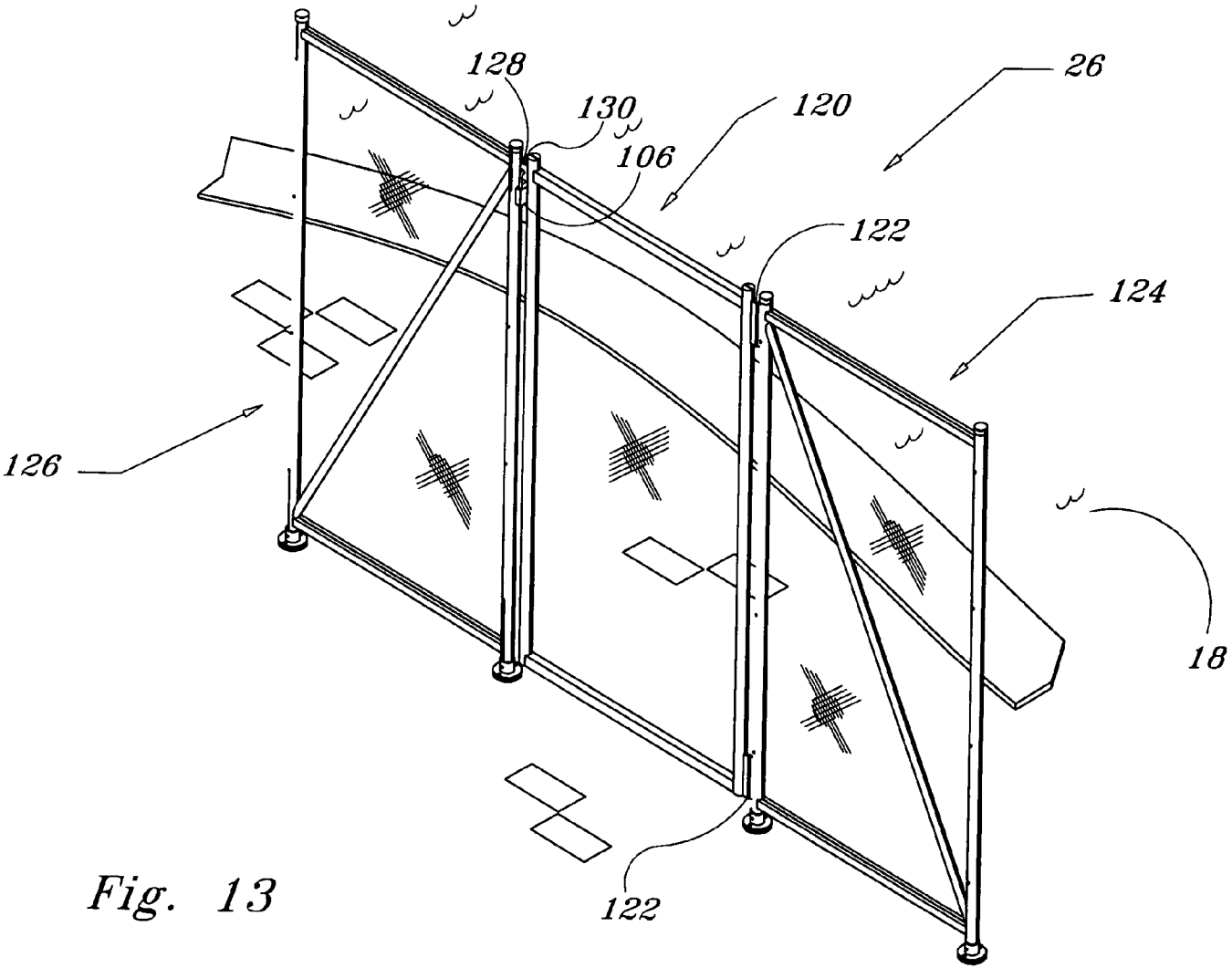
FIG. 13 is an isometric view of a gate and gate support members as would typically be used in the preferred embodiment of the present invention.

The gate 26 is also an important functional element in that it provides access to the pool 18 or other restricted area, as illustrated in FIG. 13. Two features mandate the functionality of the gate. First, the gate must include a gate door 120 to provide access to the pool. Second, that door 120 must provide restricted access with or without a person present to "guard" the gate. Several features have been added to ensure both criteria are met. The door 120 includes a set of hinges 122 which pivotally mount the door 120 to a first gate frame member 124. The gate frame member 124 provides a stable support for the door 120. The hinges 122 are preferably spring loaded to offer a bias in the direction of a "closed position". This prevents the door 120 from being inadvertently left open by a user or opened by the wind. If the door 120 is left open and unattended, the function of the fence is greatly reduced.

To latch the gate door 120 a second gate frame member 126 is provided on the other side of the door 120. Again the purpose of the second gate frame member 126 is to provide a stable and consistent support for, in this case, the gate stop 128. The gate stop 128 can be any form that is common to the art. It may be as simple as a flat piece of metal that extends from the second gate frame member 126 and contacts a gate ear 130 mounted on the gate door 120. Both the gate stop 128 and the gate ear 130 may include one or more holes, which would line up and allow a lock 106 to lock the gate door 120 to the second gate frame member 126. This feature prevents the gate door 120 from being opened when unattended by an adult or other supervisory figure.

Figure 14:
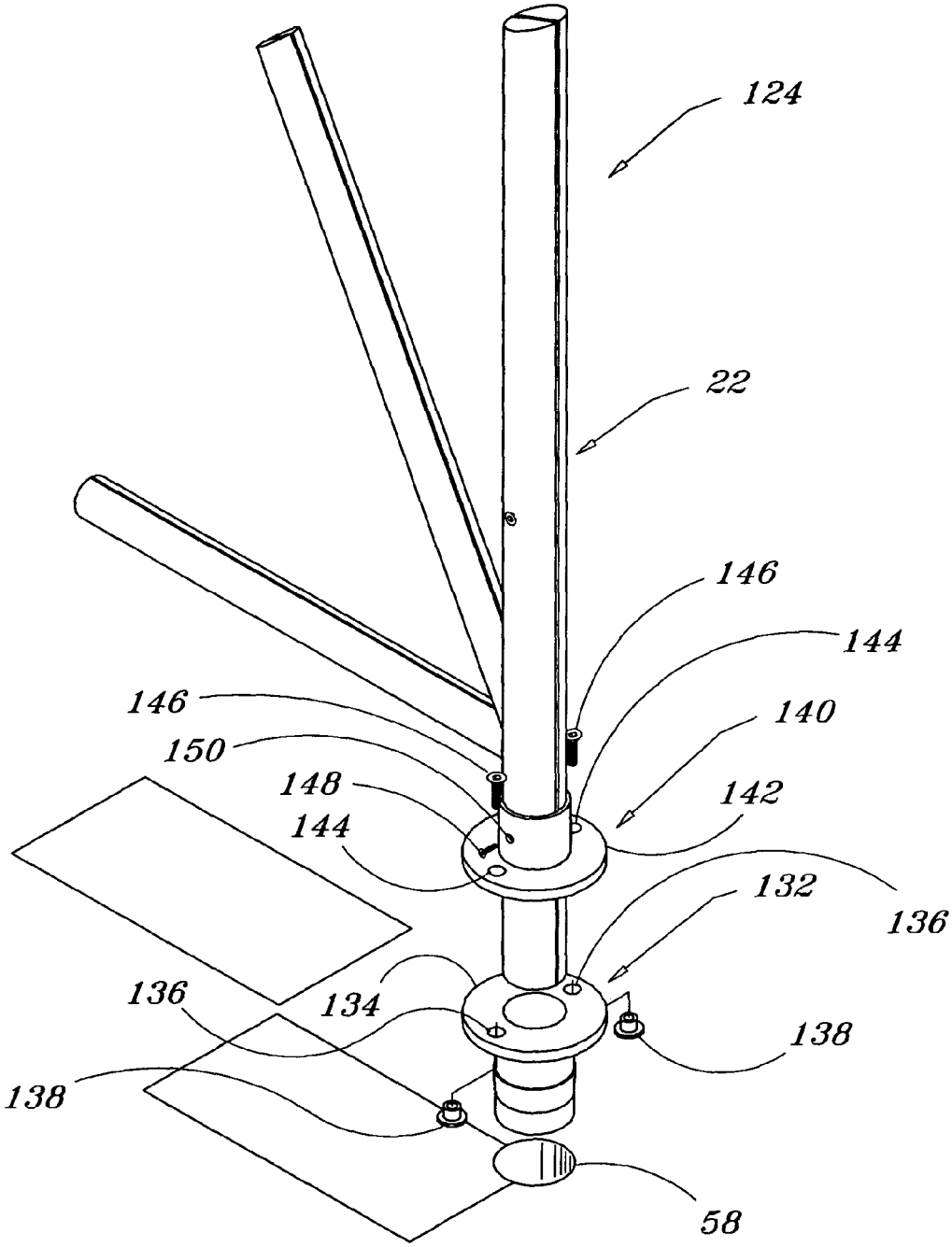
FIG. 14 is an isometric view of an outside foot of a gate support illustrating the vertical adjustment capability of the gate support members, as it would be in the preferred embodiment of the present invention.

The issue of alignment of the gate stop 128 and the gate ear 130 is an important issue. If these elements do not properly align, the locking and/or latching mechanism may not function. To address this issue, the inventor has developed a height adjustment capability on each vertical pole of each gate frame member (124 & 126) and is illustrated in FIG. 14. This is accomplished by using an insert 132 that is inserted into the ground hole 58, wherein the insert 132 includes a flange 134 with at least one hole 136. Here two holes 136 are shown, as this is the preferred embodiment as seen by the inventor. The flange sits directly on the top of the ground, as previously described, and these holes 136 are intended to receive a threaded fastener. In many cases the material of the insert 132 would not allow for effective internal threads on the holes 136, so metal inserts 138 are shown to be placed in the holes 136. A mounting collar 140 is placed over the distal end of the pole 22 of the gate frame member 124. The collar 140 also includes a flange 142 and, in this case, two fastener holes 144. The fastener holes 144 allow the fasteners 146 to pass through and be received by the threaded inserts 138 of the insert 132. A mounting screw 148 is received by the position hole 150. The mounting collar 140 can then be positioned to the necessary height on the pole 22 and locked in place by securing the screw 148 into the pole 22 to provide the gate stop 128 and gate ear 130 align properly. The collar flange 142 rests on the insert flange 134 and they are secured together by the fasteners 146. As with the rest of the fence system, the gate frame members are also preferably made in two parts so as to receive the pliable fencing material there between and fastened together as previously described.

What is disclosed herein is the preferred embodiment as seen by the inventor. It is understood that an infinite number of variations including use of various design components, fasteners and locks could be used in place of what is disclosed and are therefore inherently considered part of the present invention.

What is claimed is:

1. A safety fencing system comprising:

a plurality of substantially longitudinal poles including a first part and a second part;

a pliable fencing material received between said poles;

a plurality of inserts adapted to receive one end of each of said poles;

a plurality of fasteners adapted to secure said first part to said second part while capturing said fencing material there between, and a section lock, the section lock including a ring end secured to a first mounting bolt on a first pole and a loop end adapted to be received by a second mounting bolt on a second pole.

2. A fencing system as described in claim 1, wherein said first part and said second part of said substantially longitudinal poles include a flat edge and a curved edge, thus providing a substantially "D" shape.

3. A fencing system as described in claim 2, wherein said curved edge includes a relief track provided near the midpoint of said curved edge.

4. A fencing system as described in claim 1, wherein said first part and said second part further include a substantially convex portion on a surface of said first part and a substantially concave portion on a surface of said second part.

5. A fencing system as described in claim 4, wherein said substantially convex portion and said substantially concave portion are provided on said flat edge.

6. A fencing system as described in claim 1, wherein said pliable fencing material is comprised of a mesh material with a reinforced material border on an upper edge and a lower edge.

7. A fencing system as described in claim 1, wherein said inserts include a closed end and a flange on an opposite end with a substantially cylindrical portion there between.

8. A fencing system as described in claim 7, wherein said substantially cylindrical portion includes a ridge provided on an exterior thereof.

9. A fencing system as described in claim 8, wherein said ridge is a tapered ring provided around the perimeter of said cylindrical portion.

10. A fencing system as described in claim 1, wherein said inserts further include a mounting hole provided substantially orthogonal to a long axis of said insert.

11. A fencing system as described in claim 1, wherein said fasteners are machine screws.

12. A fencing system as described in claim 11, wherein machine screws are self tapping machine screws.

13. A fencing system as described in claim 1, further including a plurality of cup shaped caps, each with an open end adapted to receive a second end of one of said longitudinal poles.

14. A fencing system as described in claim 1, further comprising a plurality of grip mounts, each grip mount including a first half and a second half adapted to receive an outside edge of each of said first part of said pole and said second part respectively, said first half including a fastener hole and said second half including a threaded portion; and a fastener provided through said fastener hole and received by said threaded portion, whereby said fastener secures said first half to said second half about said pole.

15. A fencing system as described in claim 14, further comprising a plurality of cleats adjacent to said fastener hole, whereby said cleats contact said pliable fencing material, further securing it to said pole.

16. A fencing system as described in claim 1, wherein said loop end includes more than one loop.

17. A fencing system as described in claim 1, wherein said loop is adapted to receive a lock through said loop that is received by said second mounting bolt, thus locking said section lock between said first pole and said second pole.

18. A fencing system as described in claim 1, further including a pair of slide arms movably mounted to said section lock and adjacent to said loop and a bias to maintain a free end of said slide arms toward said loop end.

19. A fencing system as described in claim 18, wherein said slide arms include end holes adapted to receive a lock, whereby when received thereon said slide arms are restricted in movement toward said ring end.

20. A fencing system as described in claim 1, further including a gate section, the gate section including a gate door pivotally mounted to a first gate frame member.

21. A fencing system as described in claim 20, further including a second gate frame member adjacent to said gate door, opposite to said first gate frame member and including a gate stop that mates with a gate ear on said gate door.

22. A fencing system as described in claim 21, wherein said gate stop and said gate ear include at least one hole adapted to receive a lock.

23. A fencing system as described in claim 21, wherein said first gate frame member and said second gate frame member are each comprised of a first part and a second part, whereby said pliable material can be received between said first part and said second part, said first part and said second part are adapted to be fastened together securing said material there between.

24. A fencing system as described in claim 21, wherein said first gate frame member and said second gate frame member include an insert adapted to receive at least one fastener in a flange located on a distal end of said insert, and a mounting collar that is variably mounted near a distal end of a pole of said gate frame member, the mounting collar including a flange that is adapted to receive said at least one fastener, whereby said fastener secures said mounting collar to said insert enabling variable placement of a distal end of said pole relative to said flange of said insert.

25. A fencing system as described in claim 24, wherein said flange of said insert includes a threaded insert to receive said at least one fastener.

26. A method of restricting access to a controlled area such as a swimming pool including the steps of:

providing a safety fence including:

a plurality of substantially longitudinal poles including a first part and a second part;

a pliable fencing material;

a plurality of inserts adapted to receive one end of each of said poles;

a plurality of fasteners adapted to secure said first part to said second part while capturing said fencing material there between; and a section lock, the section lock including a ring end secured to a first mounting bolt on a first pole and a loop end adapted to be received by a second mounting bolt on a second pole;

drilling a plurality of holes around said controlled area;

assembling said longitudinal poles in said inserts and placing said inserts with said poles into said holes;

providing said pliable fencing material around said controlled area and between said first part and said second part of each of said poles; and fastening said first part and said second part of said poles together with said fasteners, thereby capturing said pliable material there between.

* * * * *